US006207036B1

(12) United States Patent
de Vries

(10) Patent No.: US 6,207,036 B1
(45) Date of Patent: Mar. 27, 2001

(54) ELECTROLYTIC HIGH-SPEED DEPOSITION OF ALUMINUM ON CONTINUOUS PRODUCTS

(75) Inventor: Hans de Vries, Heerde (NL)

(73) Assignee: Aluminal Oberflachentechnik GmbH (DE)

( * ) Notice: Subject to any disclaimer, the term of this patent is extended or adjusted under 35 U.S.C. 154(b) by 0 days.

(21) Appl. No.: 09/403,394

(22) PCT Filed: Apr. 15, 1998

(86) PCT No.: PCT/EP98/02197

§ 371 Date: Nov. 1, 1999

§ 102(e) Date: Nov. 1, 1999

(87) PCT Pub. No.: WO98/48082

PCT Pub. Date: Oct. 29, 1998

(30) Foreign Application Priority Data

Apr. 19, 1997 (DE) ..... 197 16 495

(51) Int. Cl.[7] ..... C25D 3/44
(52) U.S. Cl. ..... 205/237
(58) Field of Search ..... 205/237

(56) References Cited

U.S. PATENT DOCUMENTS 4,417,954 * 11/1983 Birkle et al. ..... 204/141
5,007,991 * 4/1991 Lehmkuhl et al. ..... 204/58.5
5,041,194 * 8/1991 Mori et al. ..... 204/58.5
5,091,063 * 2/1992 Lehmkuhl et al. ..... 205/237

* cited by examiner

*Primary Examiner*—Kathryn Gorgos
*Assistant Examiner*—William T. Leader
(74) *Attorney, Agent, or Firm*—Kilpatrick Stockton

(57) ABSTRACT

The invention is directed to an electrolyte for the electrolytic high-speed deposition of aluminum on continuous products, containing an organometallic aluminum complex of formula (I)

$$MF.2Al(C_3H_7)_3.nAlR_3 \quad (I),$$

wherein

M=K, Rb, Cs,

R=a $C_3$ alkyl group or a mixture of a $C_3$ and a $C_1$–$C_2$ alkyl group, n=from 0.1 to 1, in an aromatic or aliphatic hydrocarbon as solvent.

8 Claims, No Drawings

ELECTROLYTIC HIGH-SPEED DEPOSITION OF ALUMINUM ON CONTINUOUS PRODUCTS

The invention relates to an electrolyte for the electrolytic high-speed deposition of aluminum on continuous products, which electrolyte contains an organometallic aluminum complex. The invention is also directed to the use of said electrolyte in the production of corrosion-resistant and decorative coatings on continuous products in a continuous process.

By aluminizing base metals, it is possible to make them corrosion-resistant and provide them with a decorative coating. Optionally, such a coating may also be colored. The aluminum is predominantly deposited by electroplating from electrolytes enabling such an electrodeposition. Amongst the electrolytes are fused-salt electrolytes as well as electrolytes containing aluminum halides or alkyl aluminum complexes. Electrolyte systems based on alkyl aluminum complexes have gained general acceptance in the art. In general, such alkyl aluminum complexes also contain alkali complex compounds or ammonium complex compounds.

Initially, electrolyte solutions containing the $NaF.2AlEt_3$ complex dissolved in aromatic hydrocarbons such as toluene or xylene have been used almost exclusively in the electrodeposition of aluminum. However, one drawback of these electrolytes has been their very poor throwing power which, in particular, has disadvantageous effects when coating parts of complicated shape as rack products or drum products. With large parts of complicated shape having angles and corners, the poor throwing power results in incomplete and non-uniform coating.

In the course of time, therefore, electrolyte systems have been employed containing potassium halides instead of sodium halides. Potassium halides exhibit superior throwing power and have compositions such as $KF.2AlEt_3$. Furthermore, the complexes have superior electrical conductivity compared to the corresponding sodium salt complexes.

One major drawback, however, is the poor solubility of these complexes in aromatic hydrocarbons generally used as solvents, so that the common 3–4 M toluene solutions of these complexes already undergo crystallization at 60–65° C., posing a serious problem when aluminizing rack products. Further dilution of these solutions results in a massive decrease in conductivity and current density resistance, rendering the coating process uneconomic.

The use of potassium fluoride complexes containing triisobutyl aluminum as complex component has neither provided a substantial solution to these problems. Complexes of the composition $KF.2Al(iBu)_3$ have a substantially lower melting point of from 51 to 53° C., which is lower than that of the corresponding ethyl or methyl aluminum complexes. Even at room temperature and a dilution of 3–4 M in toluene, the isobutyl complexes do not crystallize. One major disadvantage of this compound, however, is to be seen in its poor current density resistance. Even at low current densities, gray coatings are formed on the objects to be coated, and there is undesirable co-deposition of potassium.

EP-A 0,402,761 and U.S. Pat. No. 4,417,954 describe prior art methods intended to solve these problems. To this end, the potassium-containing triethyl aluminum complexes used to date are to be mixed with other alkyl aluminum complexes. Such mixtures have lower melting points compared to pure triethyl aluminum complexes. In addition, they have a higher solubility in aromatic hydrocarbons. Triisobutyl aluminum and trimethyl aluminum are exemplified as admixtures. The compositions obtained in this way are acceptable for rack product aluminizing with respect to electrical conductivity, solubility and throwing power and are used on an industrial scale today.

Likewise, the EP-A 0,084,816 describes electrolytes for the electrodeposition of aluminum, wherein mixtures of aluminum alkyl complexes are used. According to the examples of this document, mixtures of triethyl aluminum and isobutyl aluminum are used, in particular.

However, such electrolytes are disadvantageous as they are not suitable for the continuous coating of continuous products such as wires, tapes, long-profiles, or pipes. Such a process and a corresponding device for the electrodeposition of aluminum on continuous products are described in the German patent application by the present applicant filed simultaneously with the present application.

The electrolytes for the electrodeposition of aluminum available up to now have a low current density resistance of only from 0.2 to 2.0 $A/dm^2$ at maximum. When exceeding the maximum limiting current density for a specific composition, the result will be burns, rough coatings and undesirable co-deposition of potassium. In particular, this is the case when adding larger amounts of triisobutyl aluminum as is the conception in EP-A 0,084,816 or EP-A 0,402,761, for example.

To date, continuous products such as wire are generally coated continuously for corrosion protection by applying a zinc coating, wherein the galvanizing technique is used. However, this is no high-quality corrosion protection because the protective coating undergoes changes even after a short period of time, forming voluminous white corrosion products on the surface as a result of oxidation of the coated zinc layer. For many applications, there is a demand for a higher quality corrosion protection which can be achieved by using electrodeposition of aluminum. Such a coating remains substantially unchanged and therefore provides a higher quality corrosion protection compared to zinc coating used so far. However, the preconditions for an economic production are that the electrolytes employed can be operated at high current density and quantitative yield, have a long service life, are cheap in production and easy to maintain.

The previously known electrolytes for the electrodeposition of aluminum are not suitable for use in such a process, as the requirements for an electrolyte in continuous coating are essentially different from those in the previously known rack product aluminizing. In the continuous coating of continuous products such as wires, tapes, long-profiles, or pipes, the parts to be coated are simple in geometry. The electrode gaps are equal in most of the cases, so that the macro throwing power of the electrolyte plays a minor role. In contrast to rack product aluminizing, the main requirement in using the electrolyte is a deposition rate as high as possible, where sufficient purity and a compact structure of the deposited layer must be achieved so that, in addition, an electrolyte having a high limiting current density is required.

It was therefore the technical object of the invention to provide an electrolyte which has the properties required for the electrolytic high-speed deposition of aluminum on continuous products, particularly a high deposition rate, a high limiting current density, permits operation with quantitative yield, has a long service life, is cheap in production and easy to maintain.

Said object is achieved by using an electrolyte containing an organometallic aluminum complex of formula (I)

$$MF.2Al(C_3H_7)_3.nAlR_3 \quad (I),$$

wherein

M=K, Rb, Cs,

R=a $C_3$ alkyl group or a mixture of a $C_3$ and a $C_1$–$C_2$ alkyl group, n=from 0.1 to 1, in an aromatic or aliphatic hydrocarbon as solvent.

To date, such an electrolyte compound has not been used in the electrodeposition of aluminum and, in particular, has not been usable in rack product aluminizing. In principle, tri-n-propyl aluminum or triisopropyl aluminum may be used as tripropyl aluminum complex. Particularly preferred, however, is the use tri-n-propyl aluminum.

Furthermore, it can be inferred from formula I that the electrolyte according to the invention also comprises alkyl aluminum admixtures which are possible in addition to the 1:2 complex. Surprisingly, it has been found that this results in higher values for the applicable limiting current density and in a reduction of the macro throwing power which, however, is of minor importance in the high speed deposition on continuous products.

It is preferred that MF in formula I be KF or CsF. In accordance with formula I, a tripropyl aluminum is provided as further component at a molar ratio relative to MF of 2:1. Preferably, tri-n-propyl aluminum is used. Furthermore, the electrolyte includes a non-complexed trialkyl aluminum at a $MF/AlR_3$ molar ratio of from 1:0.1 to 1:1, with tri-n-propyl aluminum being used in this case or mixtures of tri-n-propyl aluminum with triethyl aluminum at a ratio of from 1:10 to 10:1. The electrolyte thus composed is preferably dissolved in an aromatic hydrocarbon such as toluene or xylene, where from 1 to 4 moles of solvent per mole MF are preferably used. It is particularly preferred to use toluene or xylene as aromatic hydrocarbons.

Furthermore, suitable inhibitors may be added to achieve a more compact structure in the deposition at high current densities. To this end, aromatic or aliphatic ethers, especially anisole or methyl tert-butyl ether are preferably used.

Such an electrolyte is suitable for use in an electrolytic high speed deposition of aluminum on continuous products such as wire, tapes, long-profiles or pipes, where the aluminum can be deposited at high current densities of more than 2 to 20 $A/dm^2$.

The electrolyte solution of the invention is prepared in a conventional manner. First, the metal fluoride is added to the solvent mixture of hydrocarbons and an optional inhibitor. Thereafter, the amount of alkyl aluminum compound calculated for complex formation is added slowly in small portions. The addition is followed by heating, and stirring until all the components are completely dissolved. The solution is then cooled to room temperature and may be stored for any period of time.

For the first time, the electrolyte solution of the invention permits a high speed electrodeposition to be performed at current densities of more than 2 $A/dm^2$, where high-quality coatings are obtained. It is possible to operate at high current densities, and the electrolyte can be used up to quantitative yield. The electrolyte has a long service life, is cheap in production and easy to maintain.

The following examples are intended to illustrate the invention in more detail.

EXAMPLE 1

Preparation of the Electrolyte Solution

In a heatable stirred vessel, an electrolyte having the composition $KF.2Al(C_3H_7)_3.0.3Al(C_3H_7)_3.0.3Al(C_2H_5)_3.3$ moles of toluene was prepared under argon. To this end, the calculated amount of solvent was charged first into the stirred vessel flooded with argon. Then, the potassium fluoride previously dried at 120° C. was added with vigorous stirring. Subsequently, the calculated amounts of tripropyl aluminum and triethyl aluminum were added slowly in small portions, and the solution heated to about 80° C. Thereafter, the solution was heated until all the components had completely dissolved and then cooled to room temperature. An entirely fluid, clear solution was obtained.

EXAMPLE 2

Two aluminum anodes of 150×40 mm were positioned in a heatable cylindrical glass vessel of about 3 liters capacity equipped with a glass cap. Between the two anodes, a cylindrical copper cathode of 25 mm in diameter and 100 mm in length was fixed in the glass cap through a rotatable cathode bushing.

A coating process was carried out in the above-described vessel, using an electrolyte having the composition $KF.2Al(C_3H_7)_3.0.3Al(C_3H_7)_3.0.3Al(C_2H_5)_3.3$ moles of toluene. Following cleaning of the cathode, a 11–12 $\mu$m thick, compact, bright-white aluminum layer was deposited at a current density of 8 $A/dm^2$ D.C. and 95° C. within 7 minutes. During this period, the cathode was rotated at a speed of 400 rpm.

EXAMPLE 3

The electrolyte solution from Example 1 was concentrated to 2.5 moles toluene dilution. Subsequently, 0.5 moles of anisole per mole KF was added to the electrolyte. Likewise at 8 $A/dm^2$ and with polar reversal current, an aluminum layer about 12 $\mu$m in thickness was deposited in this electrolyte. The electrode motion (rotation) was left unchanged to be 400 rpm. The generated coating was finely crystalline, bright-white and semi-glossing.

EXAMPLE 4

In a test cell of about 6 liters capacity equipped with a lock system and flooded with Argon, a ring of steel wire 3 mm in thickness having a diameter of 100 mm was coated between 2 anode plates of about 150×150 mm. The electrolyte was $KF.2Al(C_3H_7)_3.0.2Al(C_3H_7)_3.0.6Al(C_2H_5)_3.3.5$ toluene. Coating was performed at 6 $A/dm^2$, 100° C. and with polar reversal current. The electrolyte was intensively stirred by directing an argon stream through the test cell during the coating process. The generated coating was about 12 $\mu$m thick, from matte to satin-like, finely crystalline and bright-white. The cathode yield was 99.6%.

What is claimed is:

1. An electrolyte for the electrolytic high-speed deposition of aluminum on continuous products, containing an organometallic aluminum complex of formula (I)

$$MF.2Al(C_3H_7)_3.nAlR_3 \quad (I),$$

wherein

M=K, Rb, Cs,

R=a $C_3$ alkyl group or a mixture of a $C_3$ and a $C_1$–$C_2$ alkyl group, n=from 0.1 to 1, in an aromatic or aliphatic hydrocarbon as solvent wherein the electrolyte contains from 1 to 4 moles of solvent per mole MF.

2. The electrolyte according to claim 1, characterized in that an aromatic or aliphatic ether is contained as inhibitor.

3. The electrolyte according to claim 1, characterized in that R is a mixture of $C_3$ and $C_2$ alkyl groups at a ratio from 1:10 to 10:1.

4. The electrolyte according to claim 1, characterized in that anisole is contained as inhibitor with 0.1–1 times the amount relative to MF from formula (I).

5. The electrolyte according to claim 1, characterized in that an aromatic hydrocarbon is contained as solvent.

6. The electrolyte according to claim 5, characterized in that the solvent comprises toluene.

7. Use of the electrolyte according to claim 1, for the electrolytic high speed deposition of aluminum on continuous products.

8. The use of claim 7, characterized in that the continuous products are wire, tape, long-profiles, or pipes.

* * * * *